United States Patent [19]

Strong

[11] Patent Number: 4,854,944

[45] Date of Patent: Aug. 8, 1989

[54] METHOD FOR GASIFYING TOXIC AND HAZARDOUS WASTE OIL

[76] Inventor: William H. Strong, 394 Graham Rd., S. Windsor, Conn. 06074

[21] Appl. No.: 203,342

[22] Filed: Jun. 6, 1988

Related U.S. Application Data

[60] Continuation of Ser. No. 14,310, Feb. 13, 1987, abandoned, which is a division of Ser. No. 730,453, May 6, 1985, Pat. No. 4,673,413.

[51] Int. Cl.[4] ..... C07C 4/04; C07C 9/04

[52] U.S. Cl. ..... 48/214 R; 48/211; 585/652; 585/752

[58] Field of Search ..... 48/211, 214 R, 214 A, 48/94, 105; 196/110; 208/130, 181, 185; 585/648, 652, 700, 752

[56] References Cited

U.S. PATENT DOCUMENTS

| | | | |
|---|---|---|---|
| 9,874 | 9/1881 | Ambler | 48/214 R |
| 345,649 | 7/1886 | Roberts | 48/214 R |
| 868,205 | 10/1907 | Meyer | 48/94 |
| 1,462,678 | 7/1923 | Adams | 196/110 |
| 2,029,657 | 2/1936 | Frey et al. | 48/214 A |
| 2,119,432 | 5/1938 | Harris | 48/214 R |
| 2,465,666 | 3/1949 | Stark | 48/214 A |

*Primary Examiner*—Joye Woodard
*Attorney, Agent, or Firm*—Arthur T. Fattibene

[57] ABSTRACT

A method for treating carbonaceous material, e.g. waste oil containing PCB toxic materials, by effecting the pyrolytic gasification thereof to produce a relatively high BTU content gas that is substantially free of the toxic materials to supplement or substitute for natural gas. This is attained by a furnace in which the products of combustion are utilized to separately generate steam and to preheat a supply of carbonaceous material which may be mixed with water. The generated steam is mixed with the preheated carbonaceous material and passed through a premixing and/or a primary dynamic mixer wherein the preheated carbonaceous material and steam mixture is further heated to a temperature ranging between 1600°-1800° F. to effect a partial gasification of the carbonaceous material. The partially gasified material is thereafter directed through one or more secondary dynamic mixing chambers to be further heated in the presence of additional steam to complete the gasification thereof. The generated gases are thereafter scrubbed and washed to remove any solid residue and thereafter passed through a condensor to effect the removal of any residual water; and from which the condensed gases are collected and/or stored for future use.

2 Claims, 3 Drawing Sheets

P
N

METHOD FOR GASIFYING TOXIC AND HAZARDOUS WASTE OIL

RELATED APPLICATION

This application is a continuation of application Ser. No. 07/014,310 filed Feb. 13, 1987, now abandoned, which is a division of application Ser. No. 06/730,453 filed May 6, 1985, entitled Apparatus for Gasifying Waste oil, now U.S. Pat. No. 4,673,413.

BACKGROUND OF THE INVENTION

In view of the increasing awareness of improving the ecology, it has been observed that the disposing of used or waste oil and other types of carbonaceous material presents a considerable ecological problem. Waste oil, e.g. oil that has been used in a manufacturing process and which has been contaminated with water, machine filings and other matter generally does not render such waste oil suitable for recycling. Heretofore, such used or waste oil was simply discarded. Invariably, such discarded waste oil would eventually find its way to some land fill or dump, only to pollute the surrounding area, seeping into the underground water source and the like. Frequently, even reclaimable oil is simply discarded.

In addition to the ecological problems presented by the abundance of waste oil and/or other types of carbonaceous materials, there exists a related energy crisis, viz. the progressive deterioration of the available oil and/or natural gas reserves, as more and more oil and gas is used.

As a result, many efforts have been made to supplement the natural oil and gas reserves by producing a gas substitute from coal. A number of coal gasification processes are known, e.g. as disclosed in U.S. Pat. Nos. 3,124,435 and 4,101,295. The teaching of these patents are primarily directed to a method and apparatus for effecting the gasification of coal to produce a gas substitute.

Efforts have also been made to reform hydrocarbons into gaseous products as evidenced in U.S. Pat. Nos. 3,945,805 and 3,945,806.

OBJECTS

An object of this invention is to provide a method for treating used or waste oil in an ecologically acceptable manner and for producing a high BTU content gas substitute.

Another object is to provide a method for effecting the gasification of waste oil to produce a high BTU gas substitute; which when burned is environmentally clean.

Another object is to provide a non-catalytic process for effecting the gasification of waste oil and other types of carbonaceous materials containing toxic materials.

Another object is to provide low pressure, pyrolytic process for effecting the gasification of carbonaceous materials that is environmentally clean with respect to its emissions from its feed stock.

Another object is to provide a method for reforming organic carbonaceous material to produce a usable gas.

SUMMARY OF THE INVENTION

The foregoing objects and other features and advantages are attained by a method for treating organic carbonaceous material, e.g. waste oil to produce therefrom a high BTU content gas substitute in a low pressure pyrolytic manner. This is attained in a furnace which is suitably fired to effect the separate preheating of the carbonaceous material and the generation of steam. The carbonaceous material is mixed with water and this mixture is initially pre-heated to a temperature of 200° to 600° F. and thereafter mixed with steam. The preheated material and steam mixture in one embodiment is directed to a primary dynamic mixing chamber disposed within the furnace for heating the mixture to a range of 1600° to 1800° F. The mixture may then be passed through one or more secondary mixing chambers wherein supplementary steam is added to the mixture just prior to entering the respective secondary chambers wherein the mixture is further heated to a temperature of 1800° to 2200° F.

The gases generated from the carbonaceous material in passing through the mixing chamber exit to a washing station wherein the solid residues are precipitated out. Upon washing of the generated gases, the washed gases flow through a condensor wherein the gases are cooled and the moisture carried along therewith is condensed. The cooled gases are then collected and stored for subsequent use, a portion of which may be used to fire the furnace. In accordance with this invention, the respective primary and secondary chambers are uniquely construed so as to enhance the mixing action as the temperature of the waste oil and associated steam mixed therewith are heated to the temperature sufficient to effect the gasification.

In another embodiment, the initial preheated carbonaceous material and steam are introduced into a premixing chamber wherein the carbonaceous material and steam are intimately mixed and preheated to a temperature ranging between 1500°-1700° F. From the premixing chamber, the mixture is directed to serially connected primary and secondary heating chambers where the carbonaceous material is finally heated and gasified to a temperature of 1800°-2200° F.

FEATURES

A feature of this invention resides in a method for effecting the gasification of carbonaceous material, e.g. waste oil.

Another feature resides on a pyrolytic, non-catalytic generator for processing organic carbonaceous material in an ecological manner.

Another feature resides in a method for effecting the gasification of an organic carbonaceous material, e.g. waste oil to produce a high BTU gas.

Another feature resides in the provision of a generator for treating waste oil having a mixing chamber constructed so as to enhance the mixing of the gases flowing through the generator.

BRIEF DESCRIPTION OF THE DRAWING

Other features and advantages will become readily apparent when considered in view of the drawings and specifications in which.

DETAILED DESCRIPTION

Figure 1:
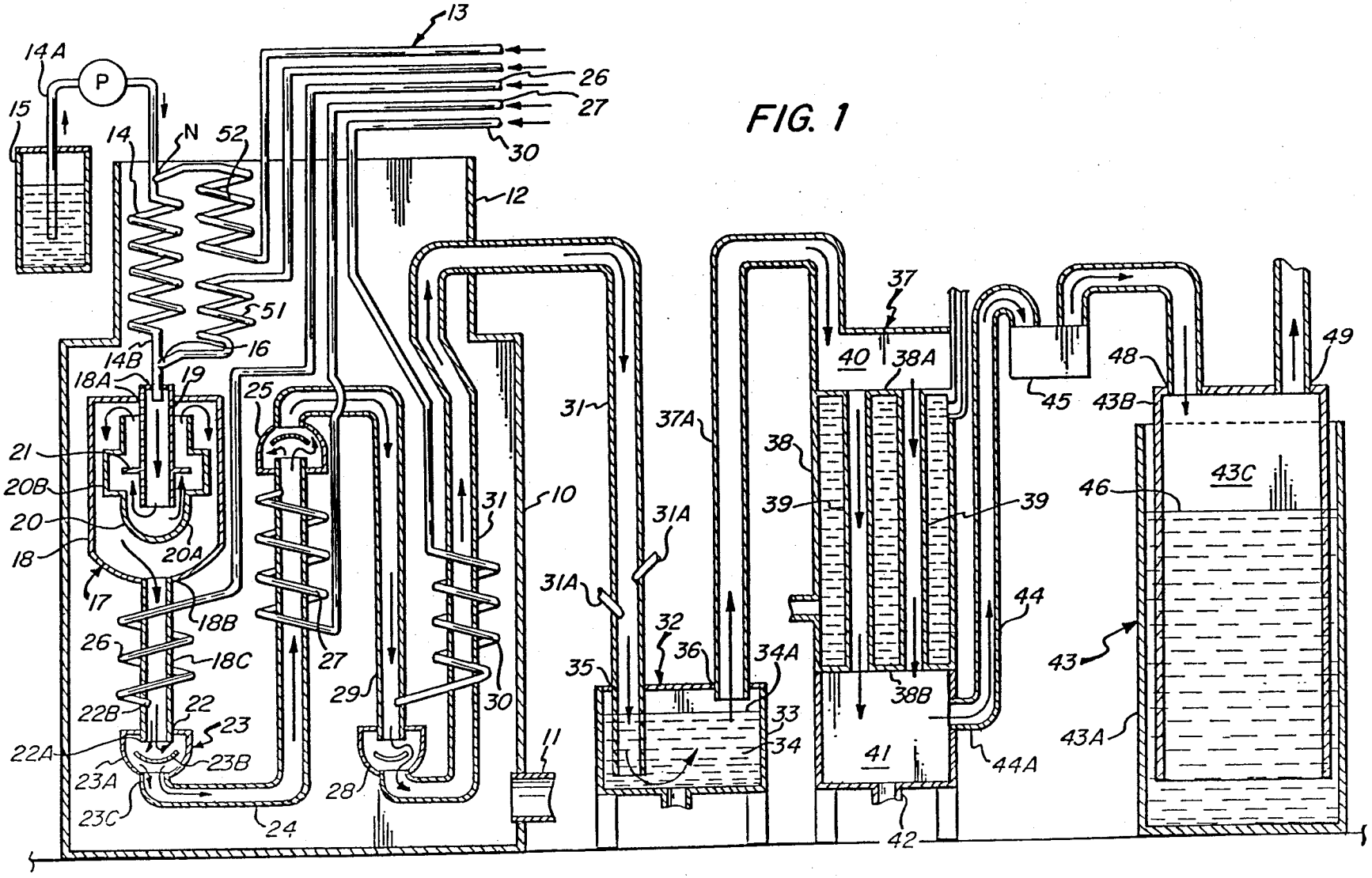
FIG. 1 is a schematic view of an apparatus embodying the invention.

Referring to the drawings, there is shown in FIG. 1, a diagrammatic representation of an apparatus to effect the handling and/or pyrolytic gasification of organic carbonaceous material. It will be understood that such carbonaceous material may comprise coal, oil, either reclaimable and/or waste oil, methane, propane, and such other material which may contain PCB or other toxic materials. For purposes of description only, reference will be made to used or waste oil. Oil used in machine shops to facilitate machining operations is a typical kind of waste oil. Such oil is often contaminated with a relatively large proportion of water and/or metal filings and/or chips. Such other waste oil may comprise oil drained from vehicles or the like.

The apparatus for handling such waste oil in accordance with this invention, comprises a furnace 10 which may be suitably fired by one or more burners 11, e.g. gas burners or the like. The upper end of the furnace 10 connects to a flue or stack portion 12, which connects to a chimney to which the combustion gases are exhausted to atmosphere. Disposed in the flue or stack portion 12 of the furnace are one or more banks of steam generating tubes 13. Also disposed within the flue or stack portion of the furnace 10 is a coil 14, through which the waste oil is directed. One end 14A of coil 14 connects to the waste oil supply 15. The other end 14B of coil 14 is in communication with a steam nozzle 16 at the end of steam tubes 13. The waste oil is pumped from its supply 15 through coil 14 past a spray nozzle 16 which is steam driven. The steam nozzle 16 is connected adjacent the end 14B of the supply coil 14 in communication with a primary mixing chamber 17 which is disposed within the furnace 10. The nozzle 16 is fed by steam generated in coil 51, which is arranged to atomize the oil in coil 14 as it enters chamber 17.

In the illustrated embodiment, the primary dynamic heating and mixing chamber 17 comprises an outer shell 18 which is closed at opposite ends, except for an inlet 18A and outlet 18B. The inlet 18A comprises a tubular conduit member 19 that extends into shell 18 and which is open at its lower end. Disposed between the outer shell 18 and conduit member 19 is an intermediate shell 20, which has a closed lower end 20A spaced from the outlet end of tubular member 19. The intermediate portion 20B is provided with an enlarged portion to accommodate a baffle 21 which circumscribes the tubular member 19. Thus, as noted by the arrows, the mixture of waste oil and steam upon entering the inlet 18A is directed down the tubular member 19 to make a series of passes within the primary mixing chamber. The tortuous path thus defined by the tubular member 19, the intermediate shell 20 and outer shell 18 enables the oil and steam to throroughly mix while being heated to a temperature ranging between 1600° to 1800° F. as it flows therethrough forming an initially or partially gasified effluent. If desired, a booster steam coil 52 is provided for generating steam used to boost the oil through coil 14. The booster steam is introduced into the oil coil 14 through a spray nozzle N.

The outlet end 18B of the outer shell 18 connects in communication with the inlet 22 of a secondary dynamic heating and mixing chamber 23. The secondary chamber 23 comprises an outer shell 23A and an inner shell 23B spaced therefrom, the latter being spaced from the extended portion 22A of the inlet 22.

The outer shell 23A is provided with an outlet 23C which connects to a conduit 24 which connects to a second, secondary heating and mixing chamber 25.

A second steam coil 26 is disposed in the furnace to be heated by the combustion gases, and it is coiled about the conduit 18C interconnecting the outlet 18B of the primary chamber 18 to the inlet of the secondary chamber 23. The steam generated in coil 26 is introduced into the inlet of the secondary chamber at 22B to mix with the waste oil and steam mixture i.e. the initial gasified effluent leaving the primary chamber 17. Connected in series with secondary chamber 23 is a second secondary chamber 25 which is constructed like the first described secondary chamber 23. A third steam coil 27 is disposed in the furnace to be heated by the combustion gases therein, and it is coiled about the conduit 24 leading to the second secondary chamber 25. Steam coil 27 is arranged to add supplemental steam to the mixture entering the inlet of the second secondary chamber 25. The described apparatus may be provided with a third secondary chamber 28, which is serially connected to the second secondary chamber 25 by an interconnecting conduit 29, and a fourth steam coil 30 is provided for adding additional steam to the mixture entering the third secondary chamber 28.

It is to be noted that the respective secondary chambers 23, 25 and 28 are serially connected and each is provided with a steam coil for adding steam to the medium flowing from the preceding mixing chamber. In the illustrated embodiment, the fourth steam coil 30 is coiled about the conduit 31, which is connected to the outlet end of the mixing chamber 28, or last secondary mixing chamber.

Mixing chambers 23, 25 and 28 are similarly constructed and each is arranged to effect a mixing of the medium flowing therethrough and which cumulatively provides the requisite residence time within the furnace, necessary for the waste oil to be gasified into its gaseous constituents wherein the material to be gasified is heated to a final temperature ranging between 1800° to 2200° F.

Upon exiting from the last mixing chamber 28, conduit 31 directs the gaseous products to a washing station 32. The washing station 32 is shown as a container 33 for holding a supply or body of water 34 having a water level 34A. The container 33 is provided with a gas inlet 35 and a gas outlet 36. It will be noted that the gas inlet extends into the washing station so that its outlet is located below the water level 34A. Thus, as the gaseous products enter the washer, the discharged gases are washed by the water, causing any solid residue within the gaseious medium to be precipitated out. The gaseous products relieved of their solid particles or residue flow through the outlet and to a condensing station 37 by way of conduit 37A. If desired, the gases generated can be precooled prior to entering the washing station 32 by providing a series of water spray nozzles 31A in communication with conduit 31 upstreamwise from the washer as shown in FIG. 1. It will be understood that nozzles 31A are connected to a suitable source of water supply.

The condensing station 37 comprises a vessel 38 having spaced apart headers 38A and 38B interconnected by a series of tubes 39 which interconnect an upper header chamber 40 to a lower header chamber 41. Between the headers 38A and 38B and surrounding the tubes 39 is a cooling medium, e.g. water. Thus, as the washed gases pass through tubes 39, they are cooled by the surrounding water or cooling medium, thereby causing any moisture content within the generated gases to condense, the condensate being collected in the lower header chamber 41 from which the water or condensate is removed through a suitable drain 42.

The gas thus cooled exits the lower header chamber 41 and are directed to a collecting tank 43 through conduit 44. Disposed between the outlet 44A of the lower header and the collecting tank 43 is a meter 45 to measure the amount of gases generated.

The collecting tank 43 comprises an outer tank 43A containing a water level 46 and an inverted open end inner tank 43B, which is rendered movable relative to the outer tank 43A. The top of the inner tank 43B is provided with an inlet 48 and an outlet 49. The arrangement is such that as the gases generated enter into the upper end of the inner tank 43B, above the water level 46, the inner tank 43B defines an expandible chamber 43C for storing the generated gas until used. It will be understood that a portion of the generated gases may be used to fire the gas burners 11 for generating the products of combustion necessary to effect the gasification of the waste oil.

Figure 2:
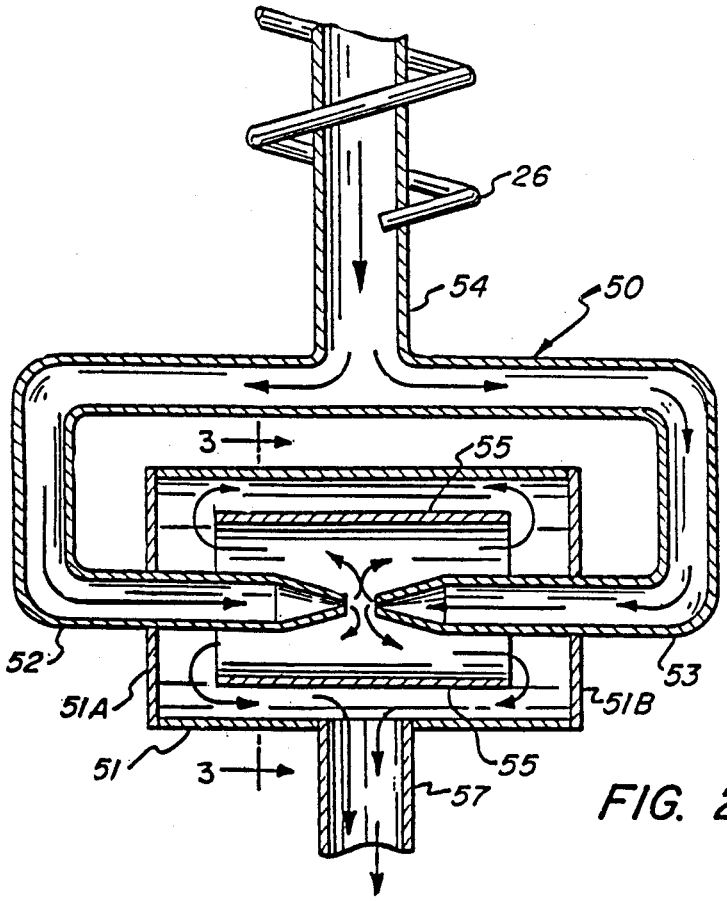
FIG. 2 is an alternate construction of a secondary mixing chamber.
Figure 3:
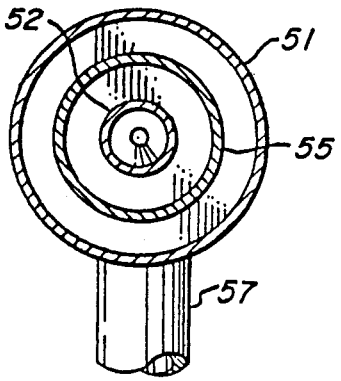
FIG. 3 is a sectional view taken on line 3—3 on FIG. 2.

FIGS. 2 and 3 illustrate a modified embodiment of a secondary mixing chamber 50, which may be utilized in the apparatus described in lieu of secondary chambers 23, 25 and 28 herein described.

As shown, the modified construction of secondary chamber 50 comprises an outer tubular shell 51, which has closed ends 51A and 51B, except for opposed inlets which connect with conduits 52 and 53, which branch off in opposite directions from the connecting conduit 54, for connecting the secondary chamber 50 to the primary mixing chamber or to preceding secondary chamber as herein described. A steam coil 26 is located contiguous to conduit 54 for directing supplemental steam to the generated gases products flowing through conduit 54 prior to entering the secondary chamber 50.

Disposed within the secondary mixing chamber 50 is a tubular inner shell 55 disposed in spaced relationship to the outer shell 51 to define open end passes within the chamber. As shown, the inlet of conduits 52 and 53 are directed toward one another whereby the gases discharging therefrom are caused to impinge on one another to provide a thorough mixing action, and whereby the gases are directed through the passages defined between the inner and outer shells, 51 and 55 respectively, as the gases flow to the outlet 57, which directs the gases to the next succeeding secondary mixing chamber as herein described or to the washer 32 as the case may be.

It will be understood that the system described can be constructed with either type of secondary mixing chamber 23 or 50, disposed in series, as herein described, so as to provide for the necessary residence time to effect the gasification of the waste oil passing through the heating chamber of the furnace. By providing a primary chamber 17 and a plurality of secondary mixing chambers in a series and utilizing the construction herein described further enables the size of the furnace to an optimum minimum.

Figure 4:
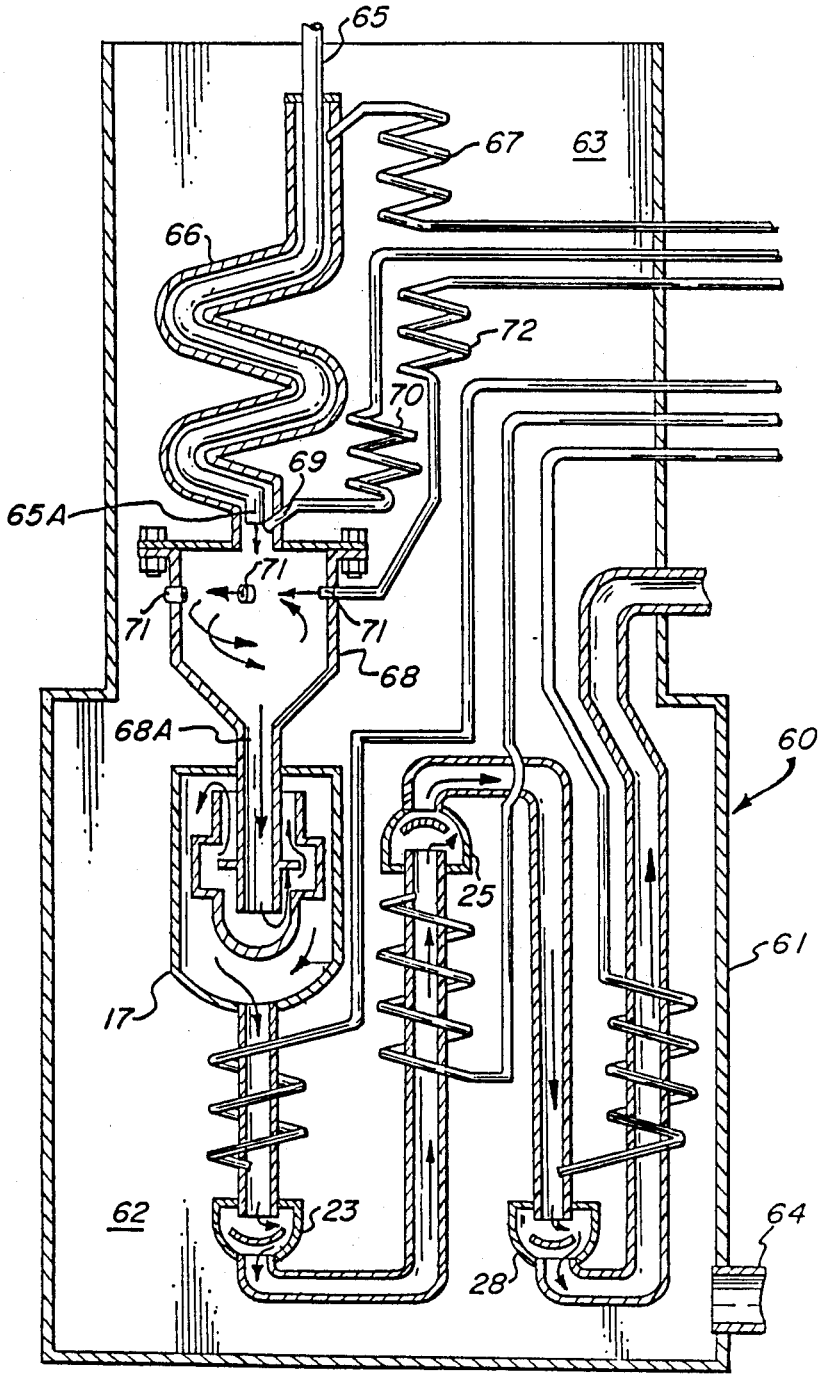
FIG. 4 is a schematic side view of a modified embodiment.

FIG. 4 illustrates a modified furnace arrangement for use in the system shown in FIG. 1. The modified furnace arrangement 60 of FIG. 4 comprises the furnace walls 61 to define the furnace primary heating furnace chamber 62 and the secondary heating portion 63, leading to the stack.

As hereinbefore described, the furnace chamber 62 is fired by one or more burners 64, preferably gas burners. In this form of the invention, the organic carbonaceous material to be gasified, e.g. oil, coal or the like, is delivered to the furnace through a supply conduit 65 which connects to a source of supply as hereinbefore described; and therefore not shown in FIG. 4.

The supply conduit 65 extends in a coil or undulating manner into the secondary heating chamber 63 of the furnace 60 to be preheated therein. In this form of the invention, the coils of the supply conduit 65 are jacketed by a complementary steam jacket 66 and which jacket is supplied with steam generated in a steam coil 67.

The supply conduit 65 and its steam jacket 66 are axially connected to the top of a mixing pre-heat chamber 66. A steam nozzle 69 connected to a steam coil 70 is disposed adjacent to outlet 65A of the supply conduit to supply supplemental steam to the material to be gasified. One or more steam nozzles 71 are tangentially disposed about the pre-mixing chamber for introducing steam generated in coils 72 tangentially about the pre-mixing chamber 68. For the foregoing, it will be noted that the axially introduced mixture through conduit 65A is impinged upon by a plurality of tangential steam nozzles 71 to provide for intimate mixing and a preheating of the medium to be gasified. The arrangement is such that the medium to be gasified, e.g. oil, is heated to a temperature of 1500°-1700° F.

From the pre-mixing chamber 68 the heated medium or partially gasified effluent is directed from the chamber's outlet 68A to the primary heating chamber 17 which is similar to that described with respect to FIG. 1. In all other respects, the apparatus to be utilized with the furnace 60 of FIG. 4 is similar to that described with respect to FIG. 1, and need not be further described.

The embodiments herein disclosed operate at relatively low pressures, e.g. 5 to 35 psi; and they are extremely safe in that the system will not explode even if a tube rupture occurs. In the event of a tube rupture, the generated gases will merely burn and not explode.

From the foregoing, it will be noted that the described apparatus enables the effecting of an efficient pyrolytic process for the treating of organic carbonaceous material so as to effect the gasification thereof in an ecological manner. While the apparatus has been particularly described with respect to effecting the gasification of oil, the same apparatus and method herein set forth can be utilized to effect the gasification of coal or any other organic type carbonaceous material, either separately and/or in combination. Thus, the apparatus is capable of generating a usable gas substitute from any organic hydrocarbon material.

A chemical analysis of one oil gasified by the foregoing described apparatus and method defined disclosed the following chemical components an concentration by volume.

| Chemical Component | Concentration Percent by Volume |
|---|---|
| Methane | 33 |
| Water | 0.9 |
| Ethylene | 16 |
| Ethane | 3.5 |
| Propene | 3.8 |
| Butadiene | 1.4 |
| Cyclopentadiene | 3.5 |
| Benzene | 14 |

-continued

| Chemical Component | Concentration Percent by Volume |
|---|---|
| Toluene | 0.7 |
| Carbon Dioxide | 23 |
| Others | 0.2 |
| | 100.0 |

The test conducted did not reveal the presences of any chlorine or sulfur containing components that could result in hydrogen chloride or sulfur dioxide formation on combustion.

While the invention has been described with respect to several embodiments thereof, it will be understood and appreciated that variations and modifications may be made without departing from the spirit or scope of the invention.

What is claimed is:

1. A method of effecting non-catalytic gasification of an organic waste hydrocarbon oil of a type containing PCB toxic materials to produce a high BTU content gas substitute in a low pressure, pyrolytic manner comprising the steps of mixing waste oil with a predetermined amount of water to form an oil-water mixture, preheating said oil-water mixture to a predetermined temperature ranging between 200° to 600° F. by an external heating means, separately generating steam by said external heating means as said oil-water mixture is being preheated, introducing said generated steam as a spray into said preheated oil-water mixture to effect an intimate mixing of said steam with said preheated oil-water mixture, heating said preheated oil-water mixture sprayed with said steam by said external heating means to form a partially gasified effluent of said pre-heated mixture having a temperature ranging between 1600° to 1800° F. in a primary dynamic mixing chamber, directing the partially gasified effluent having a temperature ranging between 1600° to 1800° F. from said primary dynamic mixing chamber to one or more serially connected secondary heating chambers heated by said external heating means to further progressively gasify said partially gasified effluent at a temperature ranging between 1800° to 2200° F. to produce a final gasification effluent, and spraying said partially gasified effluent with additional steam at each of said one or more serially connected secondary heating chambers just prior to said gasified effluent entering a respective secondary heating chamber whereby the final gasification effluent is substantially free of said toxic materials.

2. A pyrolytic gasification process for treating waste oil containing PCB toxic materials comprising the steps of mixing said waste oil with water to form an oil-water mixture and indirectly heating said oil-water mixture with steam and an external heating means, directing said indirectly heated oil-water mixture and said steam to a pre-mixing chamber, injecting supplemental steam as a spray to said heated oil-water mixture and said steam as said mixture and said steam enters into said pre-mixing chamber to initiate steam gasification of the oil to produce a partially gasified effluent, introducing additional steam tangentially of said pre-mixing chamber to effect intimate mixing of said partially gasified effluent within said pre-mixing chamber wherein said partially gasified effluent is heated to a temperature ranging between 1500° F. and 1700° F. by said external heating means, and directing said partially gasified effluent successively through a primary chamber and a plurality of serially connected secondary chambers for incrementally raising the temperature of the partially gasified effluent to a final temperature ranging between 1800° F. to 2200° F. by said external heating means to produce a final gasification effluent, and introducing steam into each of said plurality of serially connected secondary heating chambers as said partially gasified effluent is being progressively heated to said final temperature whereby said final gasification effluent is substantially free of said toxic materials.

* * * * *